US011377930B2

(12) United States Patent
Steele

(10) Patent No.: US 11,377,930 B2
(45) Date of Patent: Jul. 5, 2022

(54) ACTUATABLE DEFLECTOR FOR A COMPLETION SLEEVE IN MULTILATERAL WELLS

(71) Applicant: Halliburton Energy Services, Inc., Houston, TX (US)

(72) Inventor: David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 16/736,718

(22) Filed: Jan. 7, 2020

(65) Prior Publication Data

US 2020/0149370 A1 May 14, 2020

Related U.S. Application Data

(62) Division of application No. 15/563,947, filed as application No. PCT/US2016/068807 on Dec. 28, 2016, now Pat. No. 10,563,483.

(51) Int. Cl.

| | |
|---|---|
| ***E21B 41/00*** | (2006.01) |
| ***E21B 37/00*** | (2006.01) |
| ***E21B 7/06*** | (2006.01) |
| ***E21B 23/12*** | (2006.01) |
| ***E21B 47/09*** | (2012.01) |
| ***E21B 47/12*** | (2012.01) |

(52) U.S. Cl.

CPC ..... *E21B 41/0035* (2013.01); *E21B 7/061* (2013.01); *E21B 23/12* (2020.05); *E21B 37/00* (2013.01); *E21B 47/09* (2013.01); *E21B 47/12* (2013.01)

(58) Field of Classification Search

CPC ..... E21B 7/00

See application file for complete search history.

(56) References Cited

U.S. PATENT DOCUMENTS

| | | | |
|---|---|---|---|
| 6,019,173 | A | 2/2000 | Saurer et al. |
| 6,244,340 | B1 | 6/2001 | McGlothen et al. |

(Continued)

FOREIGN PATENT DOCUMENTS

| | | | |
|---|---|---|---|
| WO | 8001187 | A1 | 6/1980 |
| WO | 199813578 | A1 | 4/1998 |
| WO | 2013184435 | A1 | 12/2013 |

OTHER PUBLICATIONS

Great Britain Search Report and Written Opinion for Application No. GB1903531.0 dated Mar. 24, 2021.

(Continued)

*Primary Examiner* — Angela M DiTrani Leff
*Assistant Examiner* — Avi T Skaist
(74) *Attorney, Agent, or Firm* — Scott Richardson; C. Tumey Law Group PLLC

(57) ABSTRACT

A completion sleeve includes a body that defines an inner passage and a window that provides a lateral exit from the inner passage. A deflector is positioned within the inner passage and is pivotable between a stowed position, where the deflector is received within a pocket defined in a sidewall of the body, and a deployed position where the deflector is positioned to deflect downhole tools laterally through the window. An actuator is positioned within the sidewall and operatively coupled to the deflector. The actuator is actuatable to move the deflector between the stowed and deployed positions.

20 Claims, 9 Drawing Sheets

(56) References Cited

U.S. PATENT DOCUMENTS

| | | | | |
|---|---|---|---|---|
| 6,702,014 | B1 | 3/2004 | McGarian et al. | |
| 6,923,274 | B2 | 8/2005 | Rodgers et al. | |
| 7,455,110 | B2 | 11/2008 | Lynde | |
| 8,316,937 | B2 | 11/2012 | Cronley et al. | |
| 8,459,345 | B2 | 6/2013 | Bell | |
| 8,813,840 | B2 | 8/2014 | Zupanick | |
| 2003/0205374 | A1 | 11/2003 | Toulouse et al. | |
| 2004/0231850 | A1 | 11/2004 | McGarian | |
| 2005/0067166 | A1 | 3/2005 | Trueman et al. | |
| 2005/0150692 | A1* | 7/2005 | Ballantyne | E21B 41/0035 166/50 |
| 2011/0186291 | A1 | 8/2011 | Lang et al. | |
| 2012/0241144 | A1* | 9/2012 | Bell | E21B 7/061 166/117.5 |
| 2013/0327572 | A1* | 12/2013 | Sponchia | E21B 17/028 175/73 |
| 2014/0034298 | A1 | 2/2014 | Donovan | |
| 2014/0124198 | A1 | 5/2014 | Donovan | |
| 2015/0047840 | A1 | 2/2015 | Hurtado | |

OTHER PUBLICATIONS

Winton et al., "Multi-Lateral Well Construction: A Multi-Benefit Drilling Technology," 1998, IADC/SPE 39353, pp. 523-537.

International Search Report and Written Opinion for PCT/US2016/068807, dated Sep. 11, 2017.

* cited by examiner

ACTUATABLE DEFLECTOR FOR A COMPLETION SLEEVE IN MULTILATERAL WELLS

BACKGROUND

Multilateral well technology allows an operator to drill a parent wellbore, and subsequently drill one or more lateral wellbores that extend from the parent wellbore at desired depths and angular orientations. For many well completions, such as offshore deepwater wells, multiple lateral wellbores are drilled from a single parent wellbore in an effort to optimize hydrocarbon production while minimizing overall drilling and well completion costs.

Briefly, drilling a multilateral well first requires that the parent wellbore be drilled and at least partially completed by lining the parent wellbore with a string of casing or other type of wellbore liner and subsequently securing the casing to the wellbore with cement. The casing serves to strengthen the parent wellbore and facilitate isolation of certain areas of the surrounding subterranean formations for the eventual production of hydrocarbons. A casing exits (alternately referred to as a "window") is then created in the casing at a predetermined location to initiate the formation of a lateral well bore. The casing exit is formed by running a whipstock assembly into the parent wellbore and securing the whipstock assembly at the predetermined location. The whipstock assembly is then used to deflect one or more mills laterally to penetrate (i.e., cut through) the casing and form the casing exit. Once the casing exit is formed, a drill bit can then be inserted through the casing exit to drill the lateral wellbore to a desired depth, and the lateral wellbore can then be completed as desired.

Drilling and completing multilateral wellbores can be a costly and time-consuming process that requires multiple "trips" into the parent \wellbore to complete various completion tasks. Moreover, entering a drilled and completed lateral wellbore for post completion downhole operations can also require multiple trips into the parent wellbore. Accordingly, well operators are always looking for ways to reduce the number of downhole trips and thereby save time and expense.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to multilateral wellbore operations and, more particularly, to completion sleeves that incorporate a deflector that is remotely, wirelessly, or mechanically actuatable between a stowed position and a deployed position.

Embodiments described herein reduce the number of required intervention trips into a multilateral well to perform maintenance on a lateral wellbore extending from a parent wellbore. The example completion sleeve embodiments described herein each incorporate and otherwise include a deflector assembly that is remotely, wirelessly, or mechanically actuatable to move an associated deflector from a stowed position to a deployed position for deflecting downhole tools through a window defined in the completion sleeve. In its stowed position, the deflector is positioned in the sidewall of the completion sleeve to enable full-bore access through the interior of the completion sleeve. When in the deployed position, the deflector receives and deflects downhole tools out of the completion sleeve via the window. When desired, the deflector assembly may again be remotely, wirelessly, or mechanically actuated to move the deflector back to the stowed position. Including the deflector assembly in the completion sleeve advantageously eliminates at least two downhole runs that would otherwise be required in conventional completion sleeve applications to nm and install a deflector and subsequently retrieve the deflector.

Figure 1:
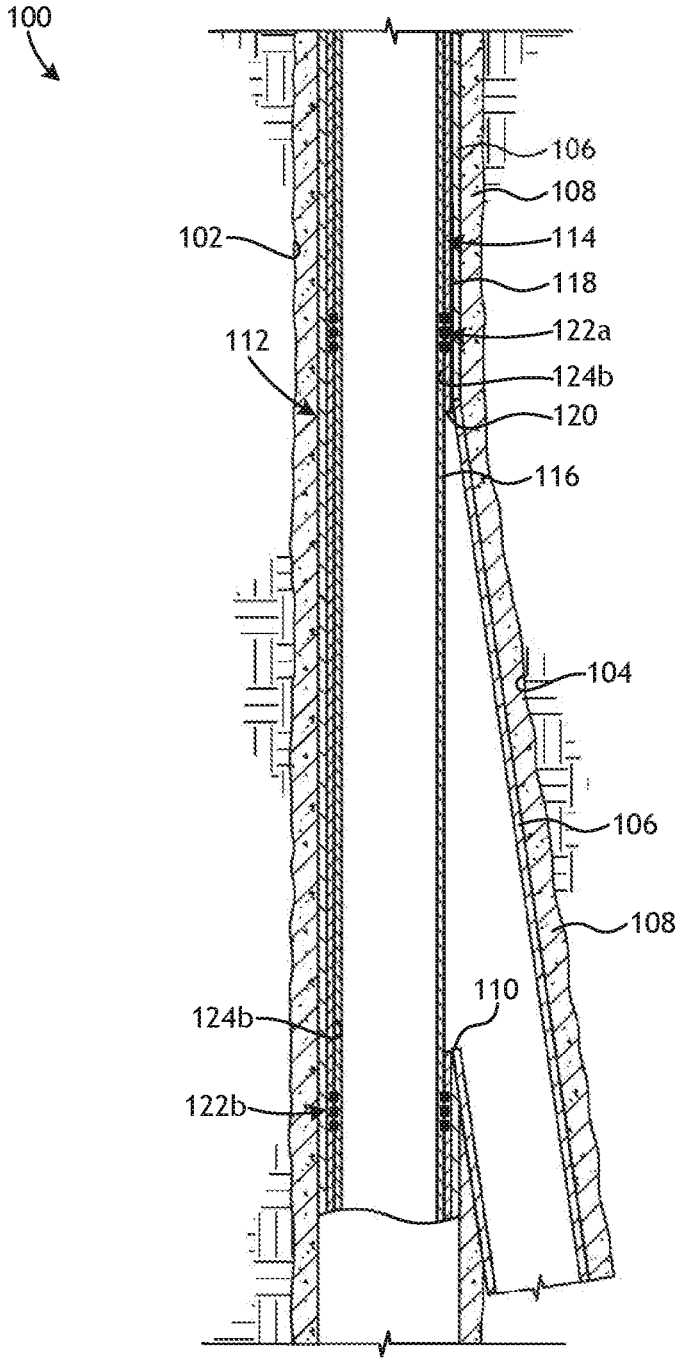
FIG. 1 is a cross-sectional side view of an exemplary well system that may incorporate the principles of the present disclosure.

FIG. 1 is a cross-sectional side view of an exemplary well system 100 that may incorporate the principles of the present disclosure, according to one or more embodiments. As illustrated, the well system 100 may include a parent well bore 102 and a lateral wellbore 104 that extends at an angle from the parent wellbore 102. The parent wellbore 102 can alternately be referred to as a primary wellbore, and the lateral wellbore 104 can be referred to as a secondary wellbore. While only one lateral wellbore 104 is depicted in FIG. 1, it will be appreciated that the well system 100 may include multiple lateral (secondary) well bores 104 extending from the parent well bore 102 at various desired locations. In addition, the well system 100 may include one or more tertiary wellbores extending from one or more secondary wellbores 104, without departing from the scope of the disclosure. Accordingly, the well system 100 may be characterized and otherwise referred to as a "multilateral" wellbore system.

The parent and lateral wellbores 102, 104 may be drilled and completed using conventional well drilling techniques. A liner or casing 106 may line each of the parent and lateral well bores 102, 104 and cement 108 may be used to secure the casing 106 therein. In some embodiments, however, the casing 106 may be omitted from the lateral wellbore 104, without departing from the scope of the disclosure. The parent and lateral wellbores 102, 104, may be drilled and completed using conventional well drilling techniques. A casing exits 110 may be milled, drilled, or otherwise defined along the casing 106 at the junction between the parent and lateral wellbores 102, 104. The casing exit 110 generally provides access for downhole tools to enter the lateral well bore 104 from the parent wellbore 102.

In the illustrated embodiment, the well system 100 has been completed by installing a reentry window assembly 112 in the parent wellbore 102. The reentry window assembly 112 includes a completion sleeve 114 and, in some embodiments, may further include an isolation sleeve 116 movably positioned within the interior of the completion sleeve 114. As illustrated, the completion sleeve 114 is positioned within the parent wellbore 102 and provides a generally cylindrical body 118 that axially spans the casing exit 110. A window 120 is defined in the completion sleeve 114, and the completion sleeve 114 may be arranged within the parent wellbore 102 such that the window 120 azimuthally and angularly aligns with the casing exit 110 and thereby provides access into the lateral wellbore 104 from the parent wellbore 102.

The isolation sleeve 116 may be positioned within the body 118 of the completion sleeve 114 and may comprise a generally tubular or cylindrical structure that is axially movable within the completion sleeve 114 between a first or "closed" position and a second or "open" position. FIG. 1 depicts the isolation sleeve 116 in the first position, where the isolation sleeve 116 occludes (covers) the window 120 and thereby prevents access into the lateral wellbore 104 from the parent wellbore 102. When in the second position, the isolation sleeve 116 is moved axially within the body 118 to expose the window 120 and thereby allow downhole tools to access the lateral wellbore 104 via the window 120. Moreover, when the isolation sleeve 116 is in the second position, production fluids (oil, gas, water, etc.) can flow through into the completion sleeve 114 via the window 120 and to production tubing coupled to the reentry window assembly 112 in the parent wellbore 102. It should also be noted that this system can also be used for injecting fluids into the parent or lateral wellbores 102, 104.

In some embodiments, as in the example of FIG. 1, a set of upper seals 122*a* and a set of lower seals 122*b* seal between the completion sleeve 114 and the isolation sleeve 116. In some applications, the upper seals 122*a* and the lower seals 122*b* are carried on the isolation sleeve 116. In such applications, the upper seals 122*a* may sealingly engage an upper seal bore 124*a* provided on the inner surface of the body 118, and the lower seals 122*b* may sealingly engage a lower seal bore 124*b* provided on the inner surface of the body 118. Alternatively, the upper and lower seals 122*a,b* may be carried on the inner diameter of the completion sleeve 114. As illustrated, the upper and lower seal bores 124*a,b* are located adjacent opposing axial ends of the window 120. Accordingly, when in the first position, the isolation sleeve 116 may provide fluid isolation between the parent and lateral wellbores 102, 104 and, more specifically, between the lateral wellbore 104 and the production tubing (or an intermediate completion tubing string) coupled to the reentry window assembly 112.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
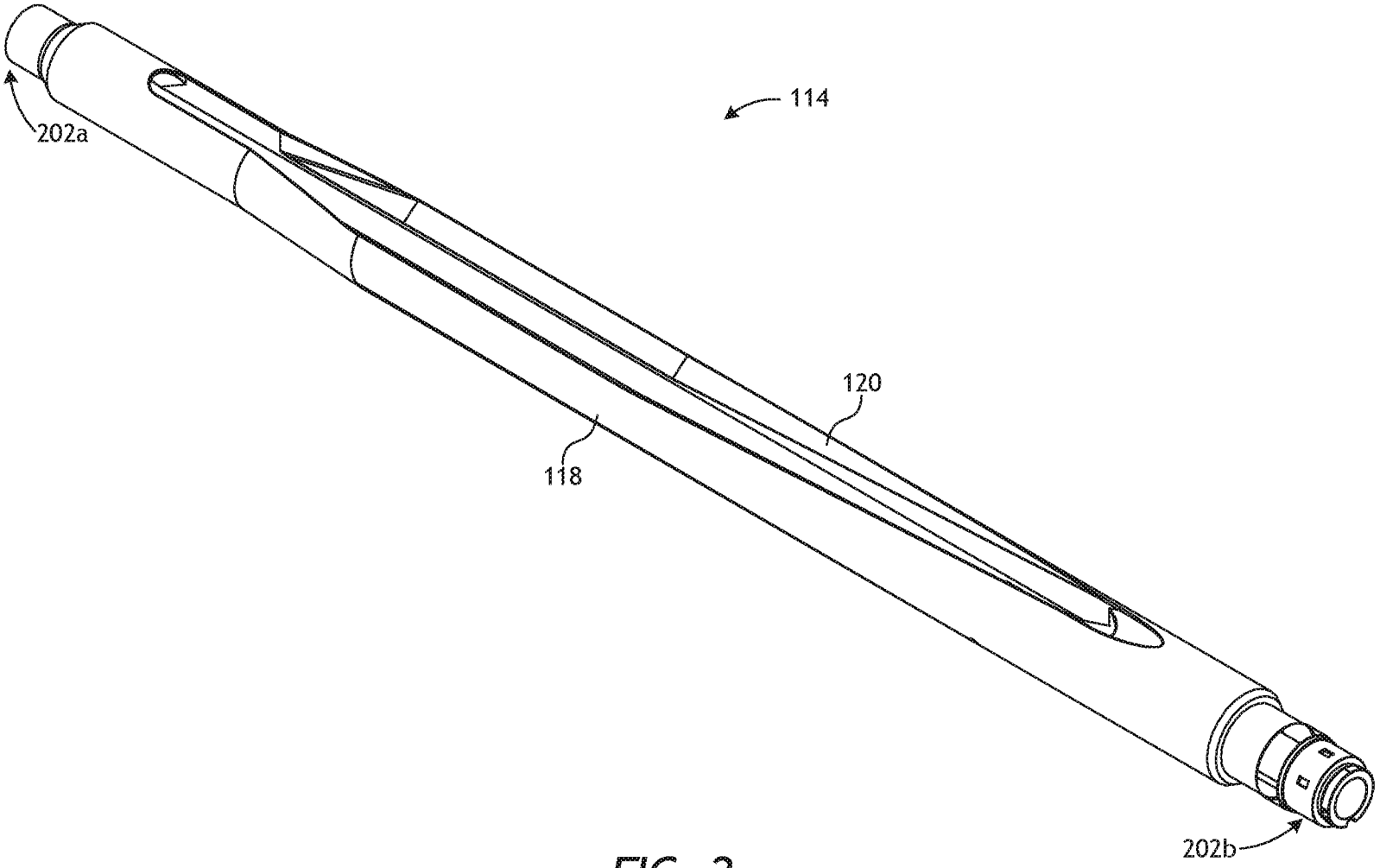
FIG. 2 is an isometric view of an example embodiment of the completion sleeve of FIG. 1.

FIG. 2 is an isometric view of an example embodiment of the completion sleeve 114 of FIG. 1. As illustrated, the completion sleeve 114 includes or otherwise comprises the generally cylindrical body 118, which has a first or "uphole" end 202*a* and a second or "downhole" end 202*b* opposite the first end 202*a*. The first end 202*a* may provide a location to couple the completion sleeve 114 to a running tool or work string (not shown) that enables a well operator to run the completion sleeve 114 downhole and into the parent wellbore 102 (FIG. 1). In other embodiments, an intermediate tubing or sub (not shown) is coupled to the first end 202*a*, which is coupled to other portions of the re-entry window assembly 112 to be run into the parent wellbore 102 on the running tool or the work string. At the second end 202*b*, in some embodiments, the completion sleeve 114 may be coupled to a latch assembly (not shown) that axially and azimuthally aligns the window 120 relative to the casing exit 110 (FIG. 1).

With conventional completion sleeves, when it is desired to convey a downhole tool (not shown) into the lateral wellbore 104 (FIG. 1), a tubing exit whipstock (TEW) assembly (alternately referred to as a "whipstock assembly" or a "deflector assembly") is first nm into the parent wellbore 102 (FIG. 1), through the production tubing string and eventually to the reentry window assembly and its completion sleeve. The TE\V is secured within or relative to the completion sleeve and includes a deflector that is aligned with the window 120 such that downhole tools subsequently conveyed into the completion sleeve engage the deflector and are deflected laterally out of the completion sleeve via the window 120. Once the desired downhole operations are completed in the lateral well bore 104, the downhole tool is then retracted back to the well surface. The TEW must then be removed from the parent well bore 102 in a separate downhole run.

According to the embodiments of the present disclosure, the presently described completion sleeve 114 incorporates and otherwise includes a deflector assembly that is remotely, wirelessly, or mechanically actuatable to move an associated deflector from a stowed position to a deployed position for deflecting downhole tools through the window 120. In some embodiments, the deflector does not obstruct the interior of the completion sleeve 114 when in the stowed position, but instead allows full-bore access through the interior of the completion sleeve 114. When in the deployed position, the deflector receives and deflects downhole tools out of the completion sleeve 114 via the window 120. When desired, the deflector assembly may again be remotely, wirelessly, or mechanically actuated to move the deflector back to the stowed position. The deflector assembly included in the completion sleeve 114 may advantageously eliminate two downhole runs required to install a TEW and later retrieve the TEW. This may also eliminate the need to de-complete a well prior to a workover operation (e.g., re-stimulation, running production logging tools, etc.).

Figure 3A:
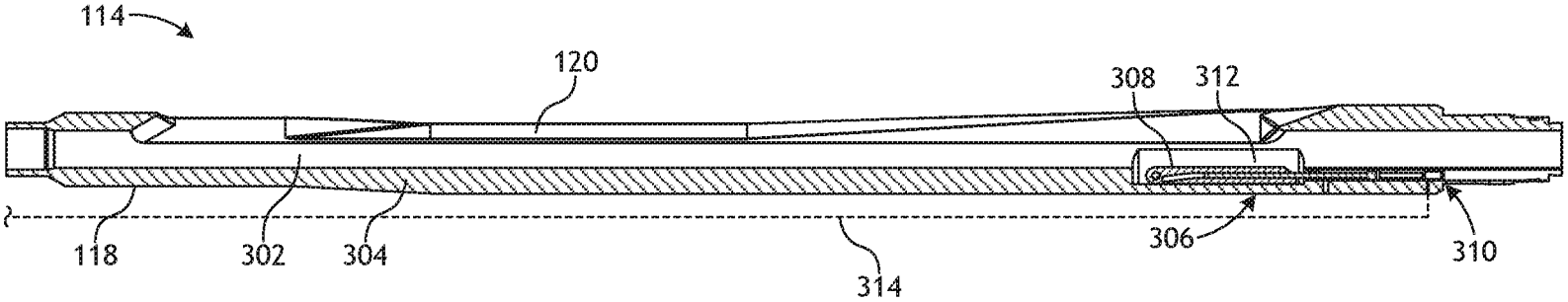
FIGS. 3A and 3B are cross-sectional side views of the completion sleeve of FIG. 1.
Figure 3B:
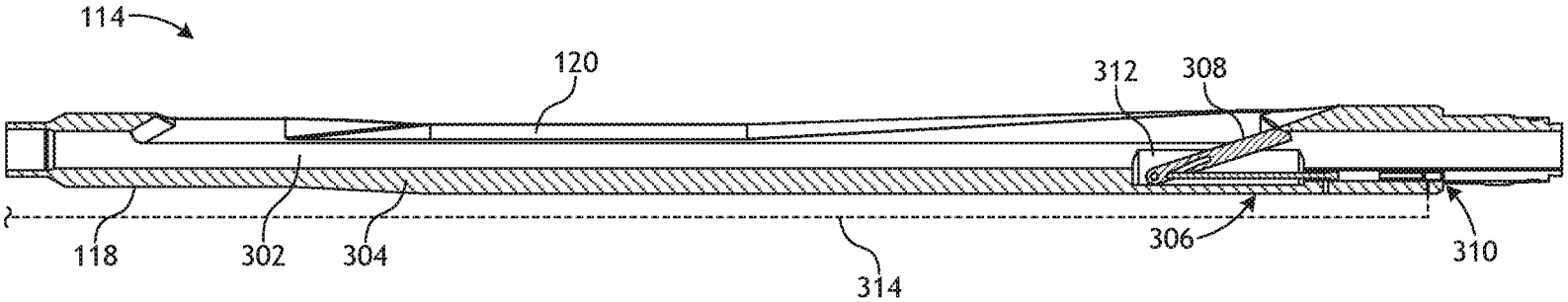

FIGS. 3A and 3B are cross-sectional side views of the completion sleeve 114, according to one or more embodiments. As illustrated, the body 118 forms a generally elongated tubular structure that defines an interior or inner passage 302. As used herein, the term "elongated" refers to having a length that is greater than a width. The body 118 includes or otherwise comprises a sidewall 304 that at least partially defines the inner passage 302. Moreover, the window 120 is defined in or through the sidewall 304 and thereby provides a lateral exit from the inner passage 302 for downhole tools entering the completion sleeve 114.

A deflector assembly 306 is included in the completion sleeve 114 and includes a deflector 308 and an actuator 310 used to move the deflector 308 between a stowed (retracted) position, as shown in FIG. 3A, and a deployed (extended)

position, as shown in FIG. 3B. The deflector assembly 306 is housed within the inner passage 302 of the completion sleeve 114. More particularly, the deflector 308 and the actuator 310 may each be housed within the sidewall 304 within the inner passage 302. The deflector 308, for example, may be pivotably secured within a recess or pocket 312 defined in the sidewall 304 within the inner passage 302. In some embodiments, the pocket 312 may be large enough to receive the deflector 308 in the stowed position such that the deflector 308 does not extend into or obstruct the inner passage 302. Accordingly, in its stowed position, the deflector 308 may allow full-bore access through the inner passage 302 for downhole tools required to pass through the completion sleeve 114. In other embodiments, however, the deflector 308 may extend partially into the inner passage 302 in the stowed position, without departing from the scope of the disclosure.

The actuator 310 may be operatively coupled (either directly or indirectly) to the deflector 308 and actuatable to move the deflector 308 between the stowed and deployed positions. In some embodiments, however, the actuator 310 may not be configured or otherwise required to move the deflector 308 back to the stowed position. In such embodiments, the deflector 308 may return to the stowed position by natural forces (e.g., gravity), spring force, or through the intervention of a downhole tool extended through the inner passage 302, for example. The actuator 310 may comprise any type of actuation device including, but not limited to, a mechanical actuator, an electric actuator, an electromechanical actuator, a hydraulic actuator, a pneumatic actuator, or any combination thereof.

In some embodiments, the actuator 310 may be remotely actuated to move the deflector 308 between the stowed and deployed positions. More specifically, a communications line 314 may be extended from a well surface location and communicably coupled to the actuator 310. Operation (actuation) of the actuator 310 may be triggered upon receipt of a control (command) signal provided via the communications line 314. The control signal may be sent by a well operator at the well surface location when desired, or the control signal may alternatively comprise an automated signal sent from a computer system located at the well surface location at a predetermined or designed time. In other embodiments, the control signal may be sent by a well operator located remote from the well surface location but in communication with the well surface location either wired or wirelessly. Accordingly, as used herein, "at the well surface location" refers to being physically located at a well site or otherwise in communication with the well site via a communication means (wired or wireless means).

The communications line 314 may comprise one or more control lines, such as hydraulic, fiber optic, and electrical lines. Accordingly, control signals provided to the actuator 310 may comprise electrical signals, hydraulic signals, optical signals, digital signals, analog signals, pulse-width modulation signals, or any combination thereof In at least one embodiment, the communications line 314 may comprise a plurality (e.g., twelve) of individual control lines provided in either single- or multiple-flat pack configurations. Moreover, the communications line 314 may provide bi-directional communication to enable the actuator 310 to communicate with the well surface location. Accordingly, and as described in more detail below, the actuator 310 may include a control module configured to receive downhole signals from the well surface location and transmit uphole signals to be received and considered at the well surface location. This may prove advantageous in providing a well operator with real-time status reports on the operational conditions of the deflector assembly 306, such as a position of the deflector 308. Various sensors could also be included in the completion sleeve 114 and communicably coupled to the control module to provide real-time reporting of the wellbore conditions, such as the fluids inside and outside of the completion sleeve 114.

Accordingly, operation of the deflector 308 can be controlled at the surface location by communicating with the actuator 310 via the communications line 314. In some embodiments, a first control signal may be communicated to the actuator 310 to move the deflector 308 to the deployed position, as shown in FIG. 3B With the deflector 308 in the deployed position, a downhole tool introduced into the inner passage 302 may engage the deflector 308, which deflects the downhole tool laterally out of the completion sleeve 114 via the window 120. A second control signal may subsequently be communicated to the actuator 310 via the communications line 314 to move the deflector 308 back to the stowed position, as shown in FIG. 3A.

Figure 4A:
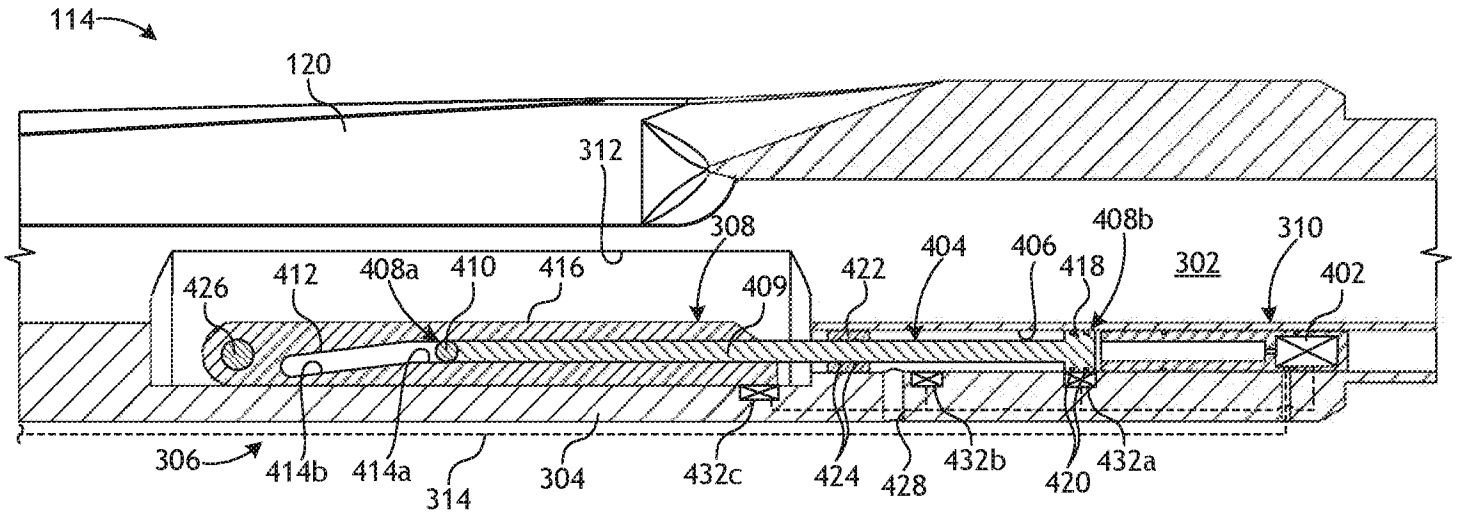
FIGS. 4A and 4B are enlarged cross-sectional side views of the example deflector assembly of the completion sleeve of FIGS. 3A-3B
Figure 4B:
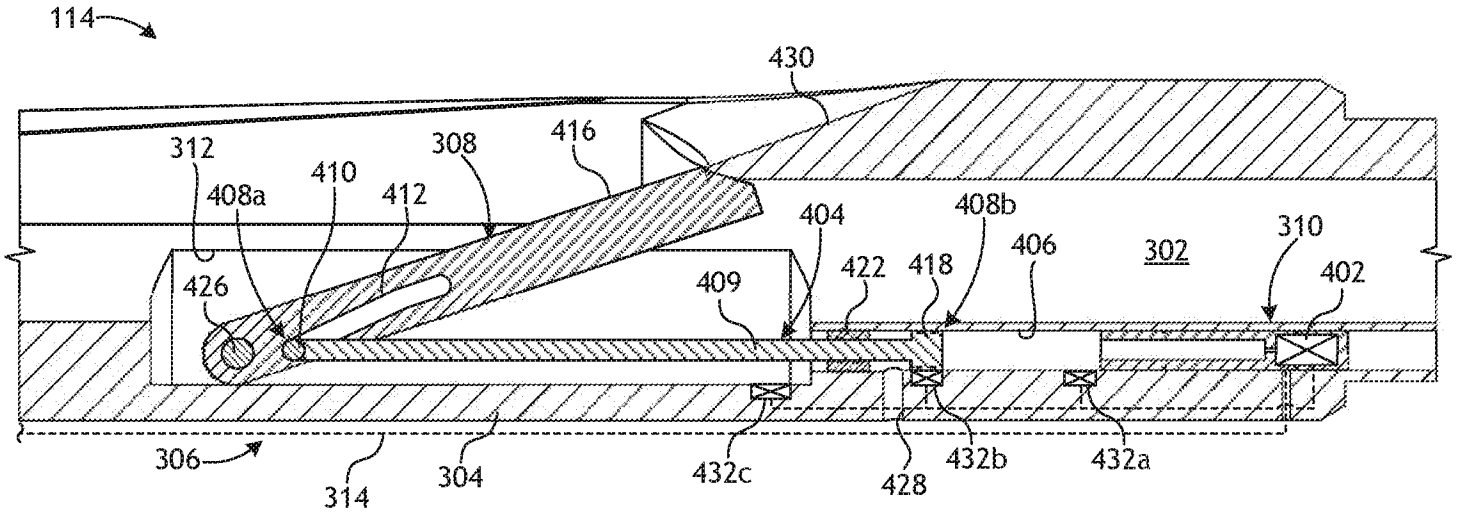

FIGS. 4A and 4B are enlarged cross-sectional side views of the example deflector assembly 306 of the completion sleeve 114 of FIGS. 3A-3B. FIG. 4A depicts the deflector 308 in the stowed position, and FIG. 4B depicts the deflector 308 in the deployed position. As illustrated, the actuator 308 may include a control module 402 communicably coupled to the communications line 314 and configured to communicate with a well surface location and operate the actuator 308, which moves the deflector 308 between the stowed and deployed positions. In some embodiments, as illustrated, the sidewall 304 of the completion sleeve 114 may be thick enough to house the control module 402 and its various components.

The control module 402 may include, for example, computer hardware and/or software used to operate the actuator 310. The computer hardware may include a processor configured to execute one or more sequences of instructions, programming stances, or code stored on a non-transitory, computer-readable medium and can include, for example, a general purpose microprocessor, a microcontroller, a digital signal processor, or any like suitable device. In some embodiments, the control module 402 may further include a power source that provides electrical power to the actuator 310 for its operation and may also provide a source of electrical power to other downhole devices. The power source may comprise, but is not limited to, one or more batteries, a fuel cell, a nuclear-based generator, a flow induced vibration power harvester, or any combination thereof. The sidewall 304 may be thick enough to store such batteries and power supplies as required. In other embodiments, however, the power source may be omitted, and electrical power required to operate the actuator 310 may be obtained via the communications line 314. Alternatively, receiving electrical power via the communications line 314 may act as a backup for a downhole power source.

The control module 402 may also include a communications module that enables transfer of data or control signals to/from the control module 402 and a well surface location during operation. The communications module may include one or more transmitters and receivers, for example, to facilitate bi-directional communication with the surface location. As a result, a well operator at the well surface location may be applied of the real-time operational conditions of the deflector assembly 306 and may be able to send command signals to the actuator 310 to adjust the position of the deflector 308 as desired.

In the illustrated embodiment, the actuator 310 comprises a hydraulic actuator that includes a piston 404 operatively coupled to the deflector 308 and movably positioned within a piston chamber 406. While the actuator 310 is described and depicted herein as a hydraulic-type actuator, it is again noted that the actuator 310 may alternatively comprise any of the actuation devices mentioned herein, or any combination thereof, without departing from the scope of the disclosure. Accordingly, it is contemplated herein to move the deflector 308 between the stowed and deployed configurations using an actuator based on any electrical, hydraulic, magnetic, and/or mechanical means. Discussion of the actuator 310 as a hydraulic-type actuator, therefore, should not be considered limiting on the scope of the disclosure.

The piston 404 includes a first end 408*a*, a second end 408*b* opposite the first end 408*a*, and a piston rod 408 that extends between the first and second ends 408*a,b*. The piston 404 is operatively coupled to the deflector 308 at the first end 408*a*. More particularly, the piston 404 may include a pin 410 or another coupling mechanism secured to the piston 404 at the first end 408*a* and extendable through a slot 412 defined in the deflector 308. As illustrated, the slot 412 may comprise and otherwise define a straight portion 414*a* that transitions into an angled portion 414*b*. The straight portion 414*a* may extend longitudinally and generally parallel to a deflector surface 416 of the deflector 308. In contrast, the angled portion 414*b* may extend at an angle offset from parallel to the deflector surface 416. The angled portion 414*b* may provide leverage for the pin 410 that helps move the deflector 308 from the stowed to deployed positions during operation.

A piston head 418 is provided at the second end 408*b* and includes one or more sealing elements 420 (two shown as O-rings) configured to sealingly engage the inner surface of the piston chamber 406. A seal ring 422 may also be positioned within the piston chamber 406 to guide the piston rod 409 during its stroke length. The seal ring 422 may include one or more sealing elements 424 (two shown as O-rings) configured to sealingly engage the outer surface of the piston rod 409.

Exemplary operation of the deflector assembly 306 of FIGS. 4A-4B is now provided. The deflector 308 is shown in FIG. 4A in the stowed position, where the deflector 308 is received within the pocket 312 defined in the sidewall 304 such that full-bore access through the inner passage 302 is allowed for downhole tools required to pass through the completion sleeve 114. When it is desired to move the deflector 308 to the deployed position, as shown in FIG. 4B, a control (command) signal is provided to the actuator 310 via the communications line 314. In some embodiments, the control signal may comprise an electrical signal received by the control module 402, which triggers actuation of the actuator 310. In such embodiments, the actuator 310 may pump a hydraulic fluid from a fluid source (not shown) into the piston chamber 406 to act on the piston head 418 and thereby move the piston 404. In other embodiments, however, the control signal may comprise hydraulic fluid provided directly to the actuator 310 via the communications line 314 and conveyed into the piston chamber 406 to act on the piston head 418.

The hydraulic fluid impinging on the piston head 418 urges the piston 408 to move within piston chamber 406. As the piston 408 moves, the deflector 308 is forced to pivot out of the pocket 312 and into the deployed position. More specifically, as the pin 410 traverses the slot 412, the pin 410 will eventually engage the angled portion 414*b*, which urges the deflector 308 to pivot about a pivot hinge 426 that pivotably couples the deflector 308 to the completion sleeve 114. To prevent hydraulic lock between the piston head 418 and the seal ring 422 within the piston chamber 406, a vent 428 may be defined in the sidewall 304 and extend between the piston chamber 406 and an exterior of the completion sleeve 114. Any fluid interposing the piston head 418 and the seal ring 422 with the piston chamber 406 can escape the piston chamber 406 via the vent 428 as the piston head 418 advances toward the seal ring 422. The vent 428 may also prove useful when the piston head 418 advances away from the seal ring 422 and a fluid may be drawn into the piston chamber 406 via the vent 428 to also prevent or mitigate hydraulic lock. This might be accomplished through the use of one or more of a check valve, a return control line, an accumulator, or any combination thereof positioned within or in fluid communication with the vent 428.

With the deflector 308 in the deployed position, downhole tools introduced into the completion sleeve 114 may be deflected laterally out of the completion sleeve 114 through the window 120 by engaging the deflector surface 416. The deflector surface 416 may have any suitable dimensions to achieve a particular deflected distance or angle. If desired, the deflector 308 may be configured to assist in retaining a downhole tool in position relative to the deflector assembly 306 when it is engaged with the deflector surface 416. For example, the deflector surface 416 may be trough-shaped, concave, or curved to assist in preventing the downhole tool from rolling off the deflector assembly 306.

In some embodiments, as depicted in FIG. 4B, when the deflector 308 is in the deployed position, the deflector surface 416 may extend generally parallel to a ramp surface 430 defined by the window 120. Consequently, downhole tools engaging and riding up the ramp surface 430 may transition to the ramp surface 430 to exit the window 120. In other embodiments, however, the deflector 308 may be positioned at other locations within the completion sleeve 114 and not necessarily at the downhole end of the window 120. Rather, the deflector 308 may be positioned at any location between the uphole and downhole ends of the window 120 as long as the deflector 308 is able to suitably deflect downhole tools out of the window 120. In such embodiments, the actuator 310 may be positioned adjacent the deflector 308 or at a location away from the deflector 308.

When it is desired to move the deflector 308 back to the stowed position, a second control signal may be communicated to the actuator 310 via the communications line 314. In at least one embodiment, the hydraulic fluid used to move the piston 404 may be drawn out of the piston chamber 406 via the communications line 314 to urge the piston 404 back toward the actuator 310, and correspondingly move the deflector 308 to the stowed position as the pin 410 traverses the slot 412. h1 other embodiments, the communications line 314 may include two hydraulic lines, one hydraulic line to actuate the deflector 308 to the deployed position and a second hydraulic line (e.g., coupled to the vent 428) to move the deflector 308 back to the stowed position.

The deflector assembly 306 may further include one or more sensors used to monitor the position of the deflector 308 during operation and report the same to the control module 402. In some embodiments, for example, the deflector assembly 306 may include a first position sensor 432*a* and a second position sensor 432*b* that may cooperatively track the position of the piston 404 within the piston chamber 306, and thereby determine the position of the deflector 308. The position sensors 432*a,b* may be positioned at or near the start and end of the stroke length of the piston 404, for example, and configured to detect the proximity of the piston head 418. In such embodiments, the position sensors 432*a,b* may comprise magnetic sensors, or any other type of proximity sensor able to detect the presence or non-presence of the piston head 418. When the first position sensor 432*a* detects proximity of the piston head 418, that may be an indication that the piston 404 is un-stroked and the deflector 308 is, therefore, in the stowed position. However, when the second position sensor 432*b* detects proximity of the piston head 418, that may be an indication that the piston 404 is fully stroked and the deflector 308 is, therefore, in the deployed position.

In another embodiment, a third position sensor 432*c* may be arranged in or adjacent the pocket 312 and configured to monitor the proximity of the deflector 308. When the third position sensor 432*c* detects proximity of the deflector 308, that may be indicative that the deflector 308 is in the stowed position. h1 contrast, when the third position sensor 432*c* fails to detect proximity of the deflector 308, that may be indicative that the deflector 308 is in the deployed position.

The position sensors 432*a-c* may each be communicably coupled (either wired or wirelessly) to the control module 402 to enable transfer of data to/from the control module 402. The control module 402 may then either store the data or transmit the real-time position of the deflector 308 to the surface location via the communications line 314. While only three position sensors 432*a-c* are depicted in FIGS. 4A-4B in specific arrangements (positions), it should be noted that the position sensors 432*a-c* might be positioned at any location in the deflector assembly 306 suitable to monitor the position of the deflector 308, without departing from the scope of the disclosure. Moreover, the position feedback obtained by the position sensors 432*a-c* may be electrical, hydraulic, optical, digital, analog, pulse-width modulation, electro-magnetic, sonic, or any combination thereof.

Figure 5:
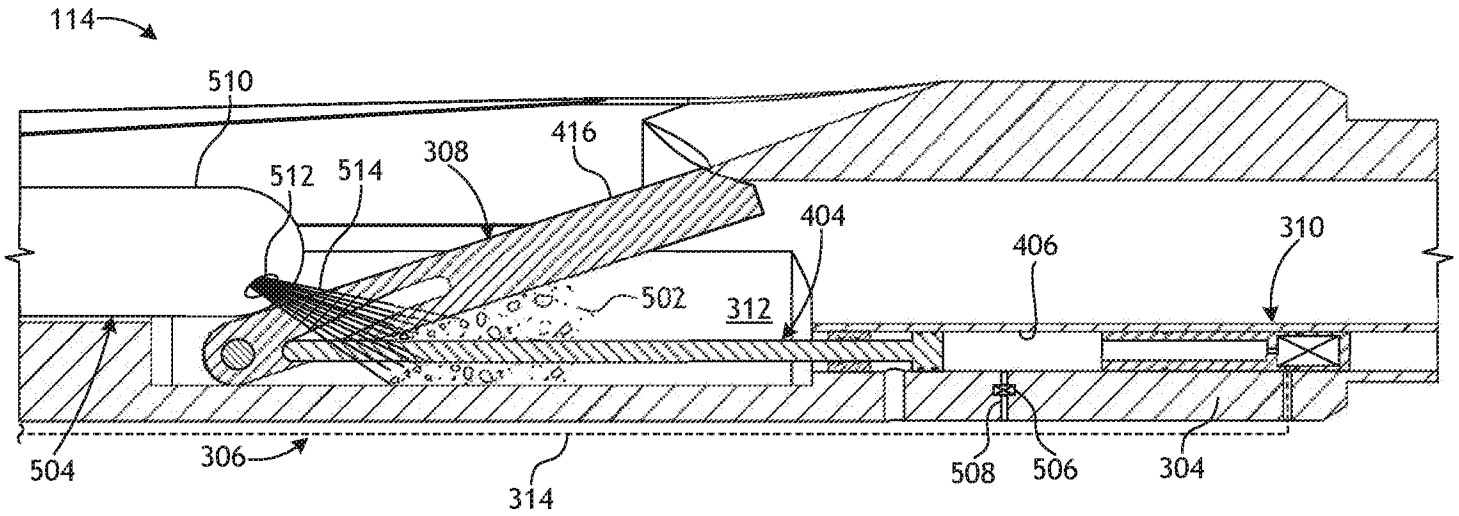
FIG. 5 is an enlarged cross-sectional side view of another embodiment of the deflector assembly and the completion sleeve of FIGS. 3A-3B.

FIG. 5 is an enlarged cross-sectional side view of another embodiment of the deflector assembly 306 and the completion sleeve 114, according to one or more additional embodiments. During use of the deflector assembly 306 and/or over extended periods of time, the deflector 308 may become stuck or otherwise fixed in the deployed position. This may result from several causes, such as failure of the actuator 310 and/or the communications line 314, debris 502 accumulating in the pocket 312 and thereby preventing the deflector 308 from returning to the stowed position, or a combination of both. To ensure that the deflector 308 can be properly returned to the stowed position when desired, the completion sleeve 114 and/or the deflector assembly 306 may further include and otherwise incorporate one or more fail-safe methods or mechanisms.

In the event the deflector 308 becomes stuck or fixed in the deployed position, for whatever reason, a downhole tool 504 may be conveyed to the completion sleeve 114 to help move the deflector 308 back to the stowed position. In some embodiments, the downhole tool 504 may be run downhole on wireline or slickline and include jarring tool (not shown). Upon engaging the deflector 308 and, more particularly, the deflector surface 416, the jarring tool may be actuated and thereby apply axial impulse loads against the deflector surface 416 in the downhole direction (i.e., to the right in FIG. 5). In other embodiments, the downhole tool 504 may be conveyed downhole on coiled tubing, production tubing, or another rigid or semi-rigid conveyance. Upon engaging the deflector 308, an axial load may be applied to the deflector 308 from the surface location via the downhole tool. The axial loading assumed by the deflector 308 in either embodiment will be transferred to the piston 404, which forces the piston 404 toward the actuator 310 and correspondingly moves the deflector 308 back into the pocket 312 and to the stowed position.

In embodiments where the actuator 310 is a hydraulic actuator, as described above, the deflector assembly 306 may further include a pressure relief valve 506 positioned within the sidewall 304 and fluidly coupled to a pressure relief conduit 508 that extends between the piston chamber 406 and an exterior of the completion sleeve 114. As the piston 404 is forced back toward the actuator 310, as described above, hydraulic fluid present in the piston chamber 406 will act on the pressure relief valve 506. Upon assuming a predetermined hydraulic loading, the pressure relief valve 506 will fail and the trapped hydraulic fluid may escape out of the piston chamber 406 via the pressure relief conduit 508, which allows the piston 404 to move back to its un-stroked position and correspondingly move the deflector 308 back to the stowed position. In some embodiments, the pressure relief valve 506 will reset automatically for subsequent use, if needed.

In some applications, debris 502 accumulated in the pocket 312 may prevent the deflector 308 from moving to the stowed position. In such applications, the downhole tool 504 may include a bullnose 510 that provides one or more jetting ports 512 (one shown) used to eject a fluid 514 at a high pressure. As the bullnose 510 approaches the deflector 308, the fluid 514 may be discharged from the jetting port(s) 512 to flush the pocket 312 and thereby remove the debris 502 so that the deflector 308 may be seated again within the pocket 312.

Figure 6A:
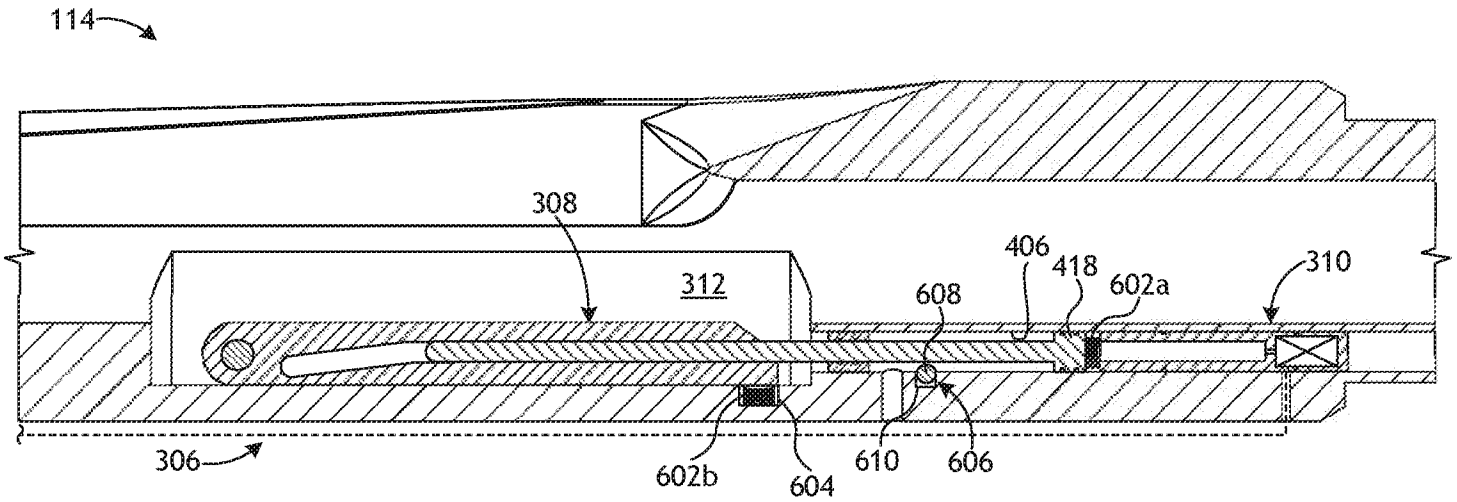
FIGS. 6A and 6B are enlarged cross-sectional side views of another embodiment of the deflector assembly and the completion sleeve of FIGS. 3A-3B.
Figure 6B:
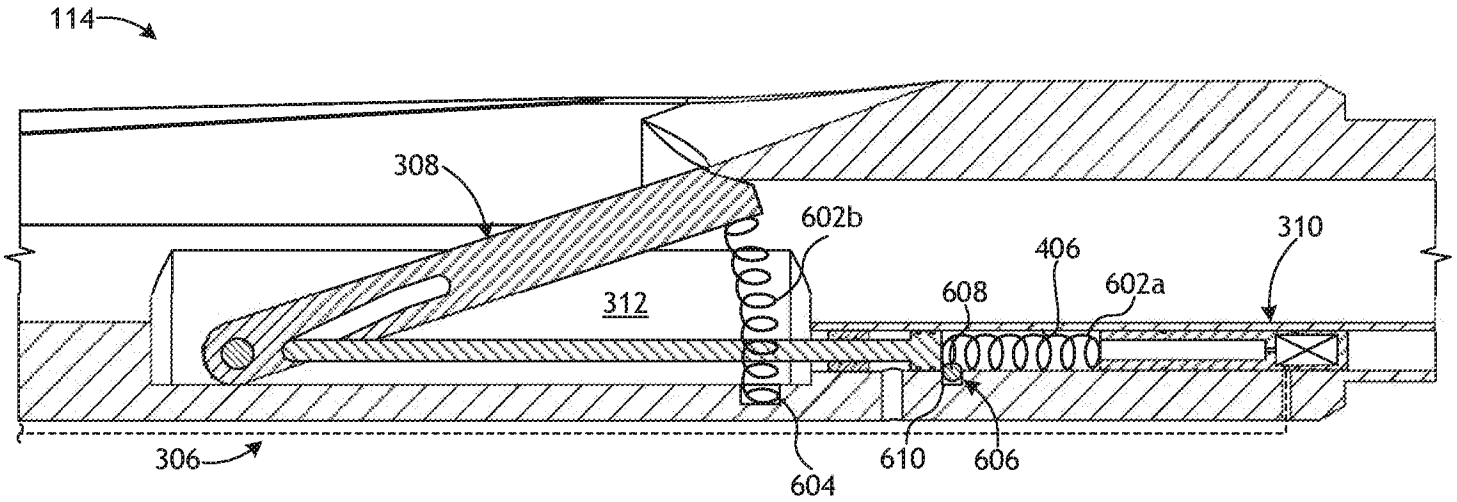

FIGS. 6A and 6B are enlarged cross-sectional side views of another embodiment of the deflector assembly 306 and the completion sleeve 114, according to one or more additional embodiments. In some embodiments, the deflector assembly 306 may further include one or more devices or mechanisms that aid in moving the deflector 308 either to the deployed position, as shown in FIG. 6B, or to the stowed position, as shown in FIG. 6A. More specifically, the deflector assembly 306 may include a first biasing device 602*a* positioned within the piston chamber 406 and interposing the piston 404 and the actuator 310. The first biasing device 602*a* may comprise a spring, for example, but could alternatively comprise any other type of biasing mechanism. In some embodiments, the first biasing device 602*a* may comprise a compression spring. In such embodiments, the first biasing device 602*a* may be configured to help move the deflector 308 to the deployed position as it acts on the piston 404. In other embodiments, however, the first biasing device 602*a* may comprise a coil spring configured to help move the deflector 308 to the stowed position as it pulls on the piston 404 back toward the actuator 310.

Alternatively, or in addition to the first biasing device 602*a*, the deflector assembly 306 may include a second biasing device 602*b* positioned within the pocket 312 and generally interposing the deflector 308 and the inner wall of the pocket 312. As illustrated, the second biasing device 602*b* may be received within a cavity 604 defined in the inner wall of the pocket 312 when fully compressed. Similar to the first biasing device 602*a*, the second biasing device 602*b* may comprise a spring, such as a compression spring. In such embodiments, the second biasing device 602*b* may be configured to help move the deflector 308 to the deployed position as it acts on the underside of the deflector 308. In other embodiments, however, the second biasing device 602*b* may comprise a coil spring that helps pull the deflector 308 back into the pocket 312 and to the stowed position.

In some embodiments, the deflector assembly 306 may further include one or more locking mechanisms 606 (one shown) configured to help permanently or temporarily lock the deflector 308 in the deployed position. In the illustrated embodiment, the locking mechanism 606 comprises a ball 608 and detent 610 mechanism, where the detent 610 is spring-loaded. In such embodiments, as the piston 404 strokes past the locking mechanism 606, the piston head 418 will engage and force the ball 608 into the detent 610, which allows the piston head 418 to bypass the locking mechanism 606. Once past the locking mechanism 606, the spring-loaded detent 610 will force the bail 608 outward again and out of the detent 610. With the ball 608 extending at least partially out of the detent 610, the piston head 418 will be prevented from moving back toward the actuator 310, thereby temporarily locking the piston 404 in place and correspondingly holding the deflector 308 in the deployed position. The piston 404 may again bypass the locking mechanism 606 upon actuation of the actuator 310 to move the deflector 308 back to the stowed position.

While the detent 610 is depicted in FIGS. 6A-6B as being defined in the sidewall 304 of the completion sleeve 114, the detent 610 could alternatively be provided on the piston 404, without departing from the scope of the disclosure. In other embodiments, two or more detents 610 may be provided either in the sidewall 304 of the completion sleeve 114 or on the piston 404 to provide a temporary lock at a corresponding two or more positions.

While the locking mechanism 606 is shown in FIGS. 6A-6B as a bail 608 and detent 610 mechanism, the locking mechanism 606 may alternatively comprise a variety of other devices located in a variety of other locations, without departing from the scope of the disclosure. In other embodiments, for instance, the locking mechanism 606 may comprise a snap ring with beveled uphole and downhole edges, where the snap ring is forced to radially contract upon engagement with the piston head 418. Alternatively, the locking mechanism 606 may be positioned at other locations within the completion sleeve 114 and still serve to permanently or temporarily lock the deflector 308 in the deployed position.

Figure 7A:
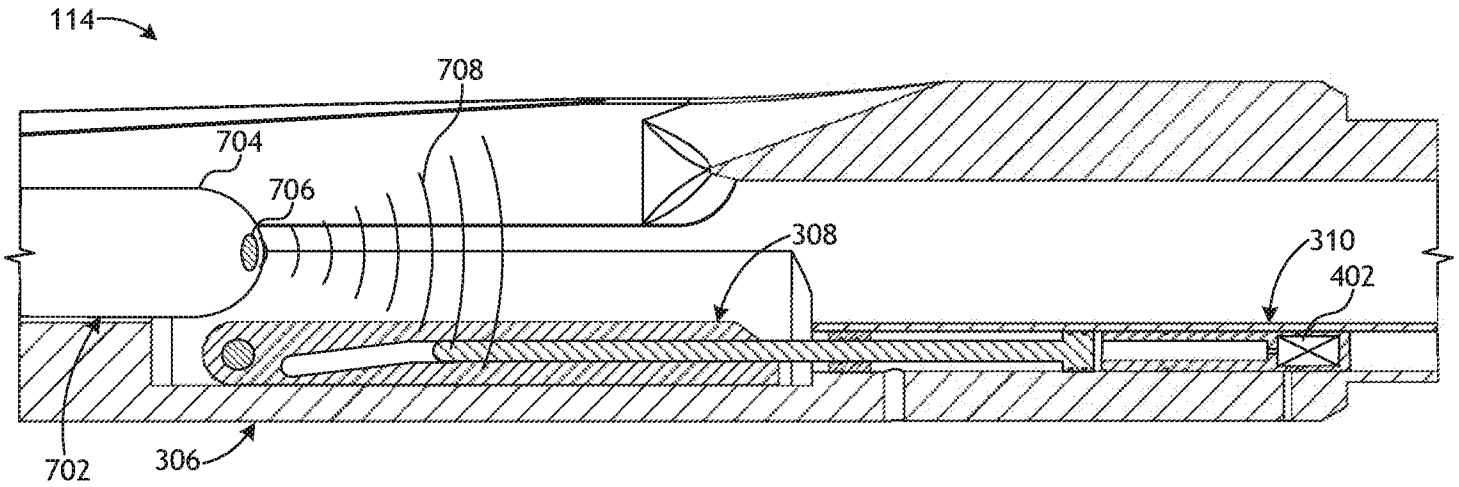
FIGS. 7A and 7B are enlarged cross-sectional side views of another embodiment of the deflector assembly and the completion sleeve of FIGS. 3A-3B.
Figure 7B:
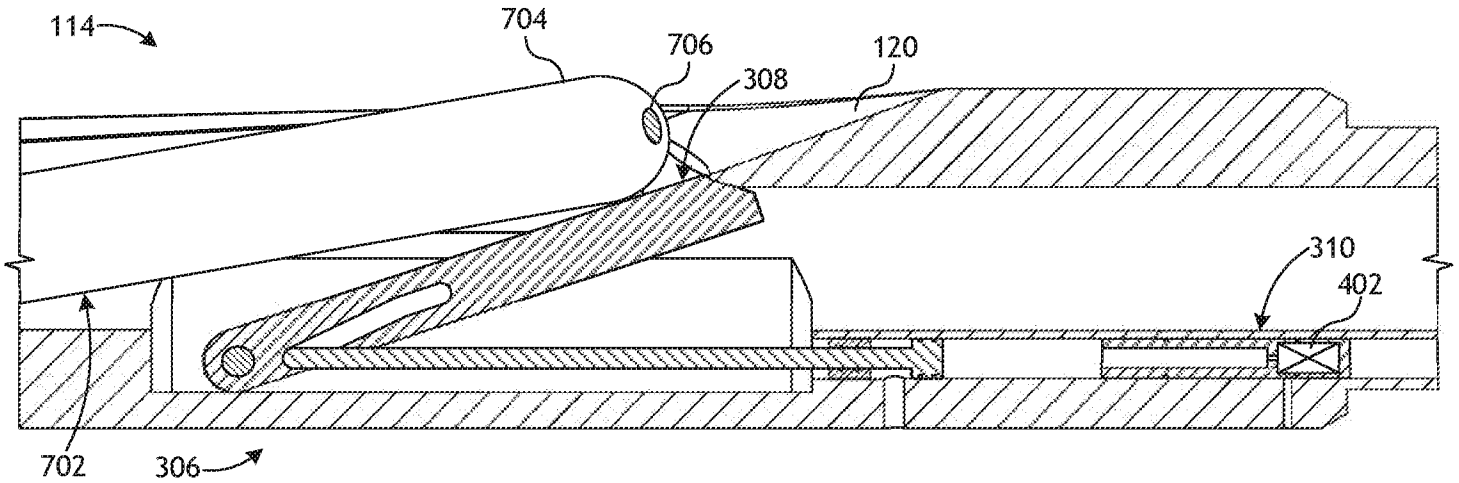

FIGS. 7A and 7B are enlarged cross-sectional side views of another embodiment of the deflector assembly 306 and the completion sleeve 114, according to one or more additional embodiments. In some embodiments, operation of the actuator 310 may be triggered upon receipt of a wireless signal. In the illustrated embodiment, for example, a downhole tool 702 is conveyed to the completion sleeve 114 and used to transmit a wireless signal that actuates the actuator 310 and thereby moves the deflector 308 from the stowed position, as shown in FIG. 7A, to the deployed position, as shown in FIG. 7B.

A bullnose 704 may be positioned at the distal end of the downhole tool 702 and a wireless transmitter 706 be installed in the bullnose 704. The wireless transmitter 706 may be configured to emit a wireless signal 708 receivable by the control module 402 and, more particularly, by one or more receivers (not shown) included in the control module 402. The receiver(s) may be configured to sense the wireless signal 708 as the downhole tool 702 approaches the deflector 308, which triggers actuation of the actuator 310 and deployment of the deflector 308 to the deployed position. As shown in FIG. 7B, the downhole tool 702 may advance out of the completion sleeve 114 via the window 120 with the deflector 308 in the deployed position. Upon retracting the downhole tool 702 following completion of the desired downhole operations, the wireless transmitter 706 may again emit the wireless signal 708 to be received by the control module 402, which triggers actuation of the actuator 310 to return the deflector 308 to the stowed position.

In some embodiments, the receiver(s) included in the control module 402 may comprise radio frequency (RF) sensors and the wireless transmitter 706 may comprise a radio frequency identification (RFID) tag that emits an RFID wireless signal 708. In at least one embodiment, the receiver (s) may comprise micro-electromechanical systems (MEMS) or devices capable of sensing radio frequencies. In such cases, the MEMS sensors may include or otherwise encompass an RF coil and thereby be used as the receiver(s). The receiver(s) may alternatively comprise a near field communication (NFC) sensor capable of establishing radio communication with a corresponding dummy tag arranged on the bullnose 704. Each NFC sensor may operate in either passive mode, where the initiator device provides a carrier field and the target device answers by modulating the existing field, or in active mode, where both initiator and target devices communicate by alternately generating their own fields. When the dummy tags come into proximity of the receiver(s), the receiver(s) may register the presence of the downhole tool 702. In yet other embodiments, other signal methods may be used, such as magnetics or mechanical sensor(s), without departing from the scope of the disclosure. It will be appreciated that the receiver(s) included in the control module 402 and the transmitter 706 of the bullnose 704 may each comprise transceivers capable of both transmission and reception of signals, without departing from the scope of the disclosure.

The above described embodiments of remotely actuating the actuator 310 or wirelessly actuating the actuator 310 using the downhole tool 702 may prove advantageous in multilateral wells having more than one lateral wellbore (e.g., the lateral wellbore 104 of FIG. 1). In such multilateral wells, separate and independent completion assemblies 114 may be installed at each lateral wellbore and a downhole tool may be run into each lateral wellbore without requiring installation and removal of a separate tubing exit whipstock (TEW) at each junction. Rather, the deflector 308 at the upper lateral wellbore may be moved to the deployed position to allow the downhole tool to enter the upper lateral wellbore. After work in the upper lateral wellbore has been completed, the downhole tool can be pulled back into the parent wellbore (e.g., the parent wellbore 102 of FIG. 1) above the upper completion assembly and the deflector 308 may then be moved back to the stowed position. The downhole tool may then be advanced downhole through the upper completion sleeve and to the lower completion sleeve where the deflector 308 of the lower completion sleeve is actuated to the deployed position to allow the downhole tool to enter the lower lateral wellbore. Following operations in the lower lateral wellbore, the downhole tool may be retracted back into the parent wellbore, and the deflector may be actuated to the stowed position to allow the downhole tool to advance even further downhole within the parent wellbore, if desired, to perform additional operations on other branches or lateral wellbores.

Figure 8A:
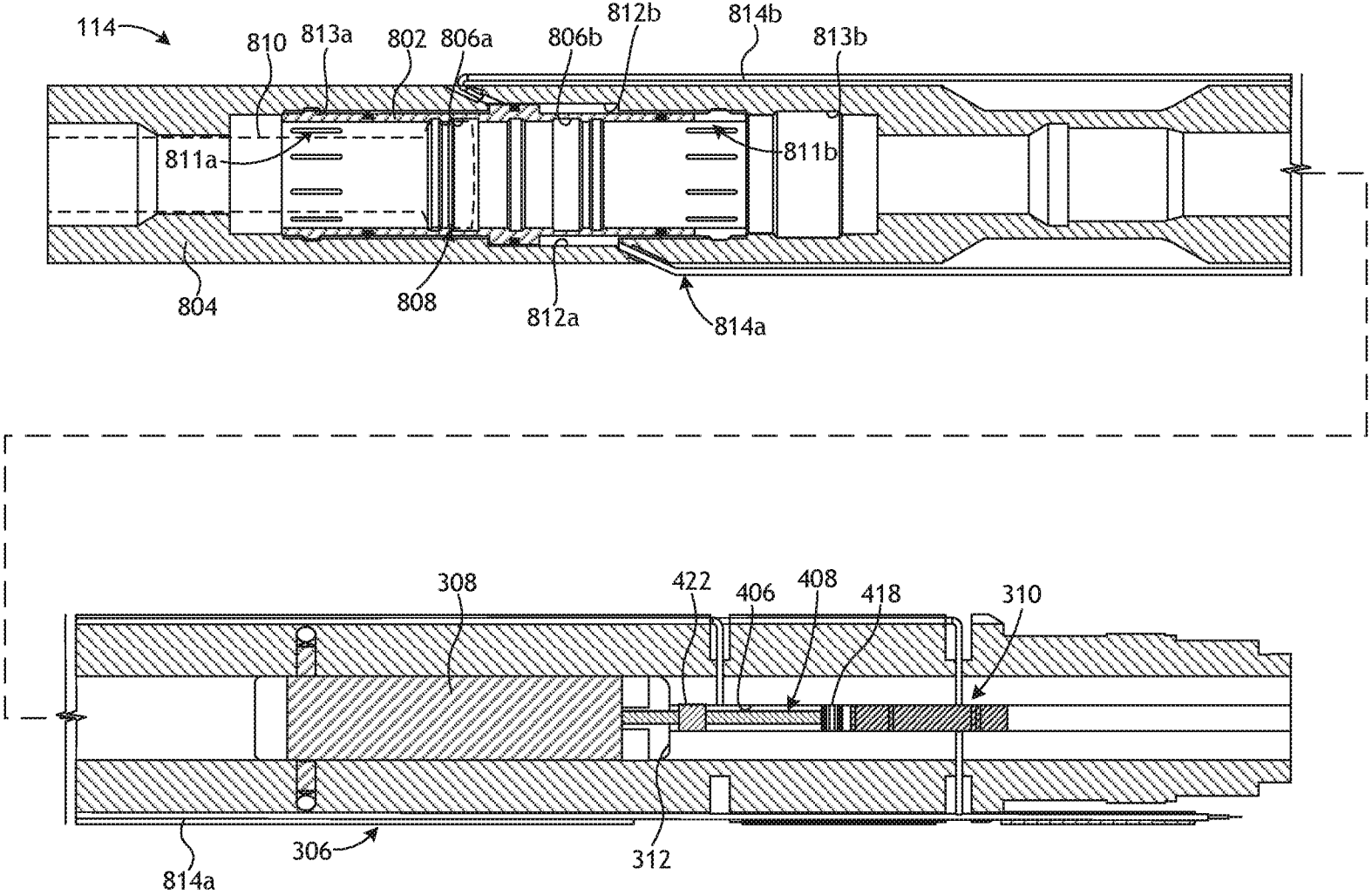
FIGS. 8A and 8B are enlarged cross-sectional side views of another embodiment of the deflector assembly and the completion sleeve of FIGS. 3A-3B.
Figure 8B:
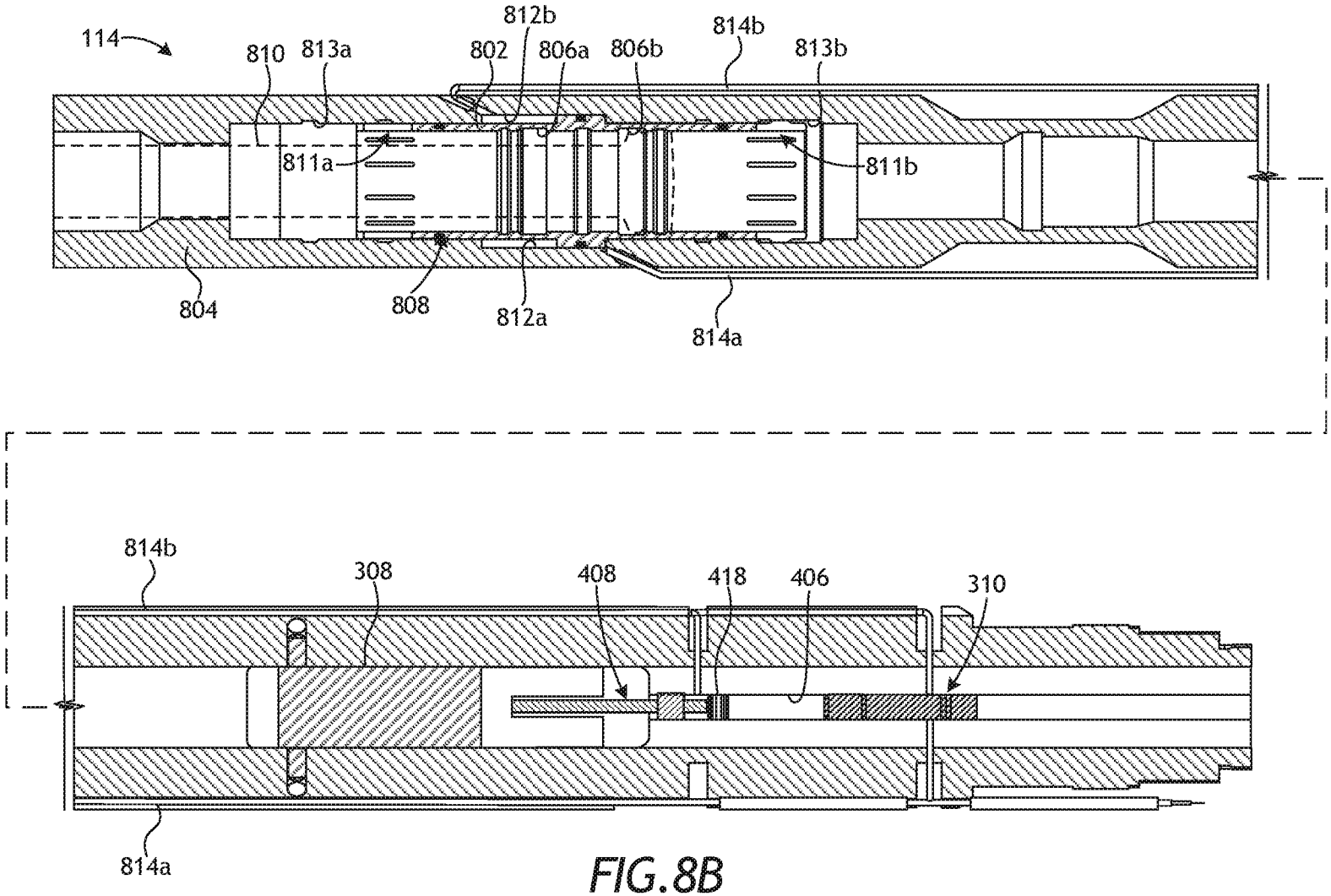

In some embodiments, the deflector 308 of any of the completion sleeves 114 described herein may be actuated mechanically as opposed to a remote actuation or a wireless signal actuation propagated through the communications line 314. FIGS. 8A and 8B, for example, are cross-sectional side views of upper and lower portions of the completion sleeve 114, according to one or more additional embodiments. To enable viewing of the component parts of the embodiment, the cross-sectional view of FIGS. 8A and 8B is 90° offset from the cross-sectional views of FIGS. 3A-3B, 4A-4B, 5, 6A-6B, and 7A-7B Accordingly, the deflector assembly 306, including the deflector 308 and the actuator 310, is shown in plan view.

In the illustrated embodiment, the completion sleeve 114 may further include a shifting sleeve 802 movably positioned within the cylindrical body 118 (FIGS. 3A-3B) or, alternatively, within a top sub 804 coupled to the body 118. In either case, the shifting sleeve 802 will be movably positioned within or otherwise in communication with the inner passage 302 (FIGS. 3A-3B) of the completion sleeve 114. The shifting sleeve 802 includes a first or upper profile 806*a* and a second or lower profile 806*b*, and the first and second profiles 806*a,b* are configured to receive and otherwise mate with a corresponding shifting tool profile 808 provided on a shifting tool 810 (shown in dashed lines). The shifting tool profile 808 may comprise, for example, one or more spring loaded keys, lugs, or dogs that exhibit a unique shape or design configured to locate and mate with the first and second profiles 804*a,b*. The shifting tool profile 808 may be configured to mate with the first (upper) profile 806*a* when moving in the downhole direction (i.e., to the right in FIG. 8), and configured to mate with the second (lower) profile 804*b* when moving in the uphole direction (i.e., to the left in FIG. 8). Alternatively, the shifting tool profile 808 may be configured to mate with the second (lower) profile 806*b* when moving in the downhole direction mate with the first (upper) profile 804*a* when moving in the downhole direction, without departing from the scope of the disclosure.

In FIG. 8A, the shifting tool 810 may be conveyed downhole to mechanically actuate the deflector 308 from the stowed to deployed positions. More specifically, as the shifting tool 810 is conveyed downhole, the shifting tool profile 808 will locate and mate with the first profile 806*a*. Once the shifting tool profile 808 mates with the first profile 806*a*, an axial load may be applied to the shifting tool 810 in the downhole direction to correspondingly move the shifting sleeve 802 in the same direction from a first position, as shown in FIG. 8A, to a second position, as shown in FIG. 8B.

In some embodiments, the shifting sleeve 802 may include a first or upper releasable coupling 811*a* and a second or lower releasable coupling 811*b*. In the illustrated embodiment, the first and second releasable couplings 811*a,b* are depicted as collet assemblies configured to mate with corresponding collet profiles 813*a,b* defined on the inner radial surface of the upper sub 804. In other embodiments, however, the first and second releasable couplings 811*a,b* may comprise other devices or mechanisms configured to releasably secure the shifting sleeve 802 within the upper sub 804 in the first and second positions. The axial load applied to the shifting tool 810 in the downhole direction may be sufficient to overcome the coupling engagement of the first releasable coupling 811*a* and thereby release the shifting sleeve 802 from the upper sub 804.

As the shifting sleeve 802 is moved to the second position and the second releasable coupling 811*b*. engages the lower collet profile 813*b*, hydraulic fluid within a first hydraulic chamber 812*a* defined in the upper sub 804 (or alternatively the body 118 of FIGS. 3A-3B) will be forced into a first control line 814*a* communicably coupled to the actuator 310. Additional hydraulic fluid will be conveyed into a second hydraulic chamber 812*b* defined in the upper sub 804 (or alternatively the body 118) via a second control line 814*b* to prevent hydraulic lock of the shifting sleeve 802. As illustrated, the second control line 814*b* may be communicably coupled to the piston chamber 406 between the hydraulic seal ring 422 and the piston head 418. Moreover, the first and second hydraulic chambers 812*a,b* are isolated from one another.

In some embodiments, the hydraulic fluid conveyed to the actuator 310 via the first control line 814*a* is used to act on the piston head 418 of the piston 408 and thereby urge the piston 408 to move within piston chamber 406 and force the deflector 308 to pivot out of the pocket 312 to the deployed position, as generally described above. In other embodiments, however, the hydraulic fluid conveyed to the actuator 310 via the first control line 814*a* may constitute a signal used to activate electrical actuation of the actuator 310 and thereby similarly deploy the deflector 308. In such embodiments, the actuator 310 may comprise an electro-hydraulic valve used to actuate the deflector 308.

Once the deflector 308 is deployed, continued axial load on the shifting tool 810 in the downhole direction will allow the shifting tool profile 808 to snap out of engagement with the first profile 806*a*, thereby freeing the shifting tool 810 from the shifting sleeve 802. Once free from the shifting sleeve 802, the shifting tool 810 may advance downhole to be deflected into the lateral wellbore 104 (FIG. 1) via the deployed deflector 308 and the window 120 (FIGS. 3A-3B) Various wellbore operations may then be undertaken in the lateral wellbore 104 before retracting the shifting tool 810 back into the parent well bore 102 (FIG. 1) to re-engage the shifting sleeve 802 and mechanically actuate the deflector 308 from the deployed position back to the stowed position.

In FIG. 8B, the shifting sleeve 802 is shown in the second or downhole position, the deflector 308 is shown in the deployed position, and the shifting tool 810 is shown engaged with the shifting sleeve 802 at the second (lower) profile 806*b*. As the shifting tool 810 is retracted back into the parent wellbore 102 (FIG. 1), the shifting tool profile 808 will eventually locate and mate with the second profile 806*b*. Once the shifting tool profile 808 mates with the second profile 806*b*, an axial load may be applied to the shifting tool 810 in the uphole direction (i.e., to the left in FIG. 8B) to correspondingly move the shifting sleeve 802 in the same direction back to the first position. The axial load applied to the shifting tool 810 in the uphole direction may be sufficient to overcome the coupling engagement of the second releasable coupling 811*b* and thereby release the shifting sleeve 802 from the upper sub 804.

As the shifting sleeve 802 is moved back to the first position, the hydraulic fluid within the second hydraulic chamber 812*b* will be forced into the piston chamber 406 via the second control line 814*b* and correspondingly act on the piston head 418 to urge the piston 408 to move back to its initial position and thereby pivot the deflector 308 back to the stowed position. In other embodiments, however, the hydraulic fluid may be conveyed to the actuator 310 via the second control line 814*a* and constitute a signal used to activate electrical actuation of the actuator 310 and thereby similarly deploy the deflector 308.

Once the shifting sleeve 802 is moved back to the first position and the deflector 308 is stowed, continued axial load on the shifting tool 810 in the uphole direction will allow the shifting tool profile 808 to snap out of engagement with the second profile 806*b*, thereby freeing the shifting tool 810 from the shifting sleeve 802. Once free from the shifting sleeve 802, the shifting tool 810 may be returned to the surface location.

Shifting tools having a profile that does not match the first or second profiles 806*a,b* will bypass or "snap through" the shifting sleeve 802 without actuating the deflector In such cases, the shifting tool may advance further downhole to interact, for example, with another reentry window assembly.

As will be appreciated, the embodiment shown in FIGS. 8A-8B may be used independently or in conjunction with any of the embodiments described herein, such as a system that can be operated and/or powered from the surface. In such embodiments, one system can act as a backup to the second system or provide the well operator the option of having two ways (means) to actuate the deflector 308 between the stowed and deployed position. In at least one embodiment, the embodiment shown in FIGS. 8A-8B may also include RFID) and/or wireless means, as described herein, to enable a third actuation option. In such embodiments, the deflector 308 could alternatively be activated by a transceiver mounted in the nose of the shifting tool 810.

While two control lines 814*a,b* are shown in FIGS. 8A-8B, more or less control lines may be used without departing from the scope of the disclosure. Moreover, other types of control lines may be included in the embodiment to transmit power, control signals, data, etc. to the completion sleeve 114, the actuator 310, tools in the lateral wellbore 104 (FIG. 1), and tools positioned downhole from the completion sleeve 114.

Embodiments disclosed herein include:

A. A completion sleeve that includes a body that defines an inner passage and a window that provides a lateral exit from the inner passage, a deflector positioned within the inner passage and pivotable between a stowed position, where the deflector is received within a pocket defined in a sidewall of the body, and a deployed position to deflect downhole tools laterally through the window, and an actuator positioned within the sidewall and operatively coupled to the deflector, the actuator being actuatable to move the deflector between the stowed and deployed positions.

B. A well system that includes a parent wellbore lined with casing that defines a casing exit, a lateral wellbore extending from the casing exit, a completion sleeve installed within the parent wellbore and defining an inner passage and a window that provides a lateral exit from the inner passage, and a deflector assembly positioned within the inner passage and including a deflector pivotable between a stowed position, where the deflector is received within a pocket defined in a sidewall of the completion sleeve, and a deployed position to deflect a downhole tool laterally through the window, and an actuator positioned within the sidewall and operatively coupled to the deflector, the actuator being actuatable to move the deflector between the stowed and deployed positions.

C. A method that includes advancing a downhole tool into a parent wellbore lined with casing that defines a casing exit and has a lateral wellbore extending from the casing exit, extending the downhole tool into a completion sleeve installed within the parent wellbore and defining an inner passage and a window aligned with the casing exit, actuating an actuator operatively coupled to a deflector and thereby moving the deflector from a stowed position, where the deflector is received within a pocket defined in a sidewall of the completion sleeve, and to a deployed position, and deflecting the downhole tool into the lateral wellbore with the deflector.

Each of embodiments A, B, and C may have one or more of the following additional elements in any combination: Element J: wherein the deflector in the stowed position allows full-bore access through the inner passage. Element 2: wherein the actuator comprises an actuation device selected from the group consisting of a mechanical actuator, an electric actuator, an electromechanical actuator, a hydraulic actuator, a pneumatic actuator, and any combination thereof. Element 3: wherein the actuator is a hydraulic actuator including a piston operatively coupled to the deflector, and wherein actuating the actuator moves the piston within a piston chamber and correspondingly moves the deflector between the stowed and deployed positions. Element 4: wherein the piston includes a pin received within a slot defined in the deflector and moving the piston within the piston chamber correspondingly moves the pin within the slot to pivot the deflector between the stowed and deployed positions. Element 5: further comprising a biasing device positioned in the piston chamber and interposing the piston and the actuator. Element 6: further comprising one or more sensors coupled to the body to detect a position of the deflector. Element 7: further comprising a biasing device positioned within the pocket and coupled to an underside of the deflector. Element 8: further comprising a locking mechanism secured to the body to lock the deflector in the deployed position.

Element 9: wherein the actuator comprises an actuation device selected from the group consisting of a mechanical actuator, an electric actuator, an electromechanical actuator, a hydraulic actuator, a pneumatic actuator, and any combination thereof. Element 10: further comprising a communications line extended from a well surface location and communicably coupled to the actuator to remotely actuate the actuator. Element 11: wherein the communications line is communicably coupled to a control module of the actuator and the deflector assembly further includes one or more sensors coupled to the body and communicably coupled to the control module, the one or more sensors being configured to detect a position of the deflector. Element 12: wherein the downhole tool includes a wireless transmitter that emits a wireless signal receivable by the actuator to actuate the actuator. Element 13: further comprising a shifting sleeve movably positioned within the inner passage and providing first profile and a second profile, and a shifting tool conveyable into the completion sleeve and providing a shifting tool profile matable with the first and second profiles, wherein mating the shifting tool profile with the first profile and providing an axial load in a first direction results in a first hydraulic signal that actuates the actuator to move the deflector to the deployed position, and wherein mating the shifting tool profile with the second profile and providing an axial load in a second direction opposite the first direction results in a second hydraulic signal that actuates the actuator to move the deflector to the stowed position.

Element 14: wherein actuating the actuator comprises transmitting a control signal to the actuator via a communications line extended from a well surface location and communicably coupled to the actuator Element 15. wherein actuating the actuator comprises emitting a wireless signal from a wireless transmitter included in the downhole tool and receiving the wireless signal with the actuator to actuate the actuator. Element 16: further comprising applying an axial load to the deflector with the downhole tool to move the deflector back to the stowed position. Element 17: further comprising ejecting a fluid out of the downhole tool to clear debris accumulated in the pocket. Element 18: further comprising actuating the actuator to move the actuator back to the stowed position. Element 19: wherein the downhole tool comprises a shifting tool that provides a shifting tool profile, wherein advancing the downhole tool into the parent wellbore further comprises locating and mating the shifting tool profile on a first profile of a shifting sleeve movably positioned within the inner passage, applying an axial load on the shifting sleeve in a first direction via the shifting tool and thereby providing a first hydraulic signal that actuates the actuator to move the deflector to the deployed position, locating and mating the shifting tool profile on a second profile of the shifting sleeve, and applying an axial load on the shifting sleeve in a second direction opposite the first direction via the shifting tool and thereby providing a second hydraulic signal that actuates the actuator to move the deflector to the stowed position.

By way of non-limiting example, exemplary combinations applicable to A, B, and C include: Element 3 with Element 4; Element 3 with Element 5; and Element 10 with Element 11.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. AU numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By, way of example, the phrases "at least one of A, B, and C" or "at least one of A, B, or C" each refer to only A, only B, or only C; any combination of A, B, and C; and/or at least one of each of A, B, and C.

The invention claimed is:

1. A method, comprising:

advancing a downhole tool into a parent wellbore lined with casing that defines a casing exit and has a lateral wellbore extending from the casing exit;

extending the downhole tool into a completion sleeve installed within the parent wellbore and defining an inner passage and a window aligned with the casing exit;

actuating an actuator operatively coupled to a deflector and thereby moving the deflector from a stowed position, where the deflector is received within a pocket defined in a sidewall of the completion sleeve, and to a deployed position;

deflecting the downhole tool into the lateral wellbore with the deflector; and wherein the downhole tool comprises a shifting tool that provides a shifting tool profile, wherein advancing the downhole tool into the parent wellbore further comprises:

locating and mating the shifting tool profile on a first profile of a shifting sleeve movably positioned within the inner passage;

applying an axial load on the shifting sleeve in a first direction via the shifting tool and thereby providing a first hydraulic signal that actuates the actuator to move the deflector to the deployed position;

locating and mating the shifting tool profile on a second profile of the shifting sleeve; and applying an axial load on the shifting sleeve in a second direction opposite the first direction via the shifting tool and thereby providing a second hydraulic signal that actuates the actuator to move the deflector to the stowed position.

2. The method of claim 1, further comprising applying an axial load to the deflector with the downhole tool to move the deflector back to the stowed position.

3. The method of claim 1, further comprising ejecting a fluid out of the downhole tool to clear debris accumulated in the pocket.

4. The method of claim 1, further comprising actuating the actuator to move the deflector back to the stowed position.

5. The method of claim 1, wherein moving the deflector back to the stowed position allows full-bore access through the inner passage.

6. The method of claim 1, wherein the actuator is a hydraulic actuator comprising a piston operatively coupled to the deflector, and wherein actuating the actuator moves the piston within a piston chamber and correspondingly moves the deflector between the stowed and deployed positions.

7. The method of claim 6, wherein the piston comprises a pin received within a slot defined in the deflector and moving the piston within the piston chamber correspondingly moves the pin within the slot to pivot the deflector between the stowed and deployed positions.

8. The method of claim 6, further comprising a biasing device positioned in the piston chamber and interposing the piston and actuator.

9. A method, comprising:

advancing a downhole tool into a parent wellbore lined with casing that defines a casing exit and has a lateral wellbore extending from the casing exit;

extending the downhole tool into a completion sleeve installed within the parent wellbore and defining an inner passage and a window aligned with the casing exit;

positioning a shifting sleeve within the inner passage and providing a first profile a second profile;

conveying a shifting tool into the completion sleeve and providing a shifting tool profile matable within the first and second profiles;

actuating an actuator operatively coupled to a deflector and thereby moving the deflector from a stowed position, where the deflector is received within a pocket defined in a sidewall of the completion sleeve, and to a deployed position; and deflecting the downhole tool into the lateral wellbore with the deflector;

wherein mating the shifting tool profile with the first profile and providing an axial load in a first direction results in a first hydraulic signal that actuates the actuator to move the deflector to the deployed position; and wherein mating the shifting tool profile with the second profile and providing an axial load in a second direction opposite the first direction results in a second hydraulic signal that actuates the actuator to move the deflector to the stowed position.

10. The method of claim 9, wherein the actuator is a hydraulic actuator comprising a piston operatively coupled to the deflector, and wherein actuating the actuator moves the piston within a piston chamber and correspondingly moves the deflector between the stowed and deployed positions.

11. The method of claim 1, further comprising moving the deflector from a stowed position to extend partially into the inner passage of the completion sleeve.

12. The method of claim 1, further comprising stowing the deflector such that the deflector does not obstruct the inner passage.

13. The method of claim 1, further comprising pivoting the deflector.

14. The method of claim 1, further comprising preventing locking of the actuator with a vent that is disposed in the sidewall of the completion sleeve.

15. The method of claim 9, further comprising moving the deflector from a stowed position to extend partially into the inner passage of the completion sleeve.

16. The method of claim 9, further comprising stowing the deflector such that the deflector does not obstruct the inner passage.

17. The method of claim 9, further comprising pivoting the deflector.

18. The method of claim 1, further comprising preventing locking of the actuator.

19. The method of claim 9, further comprising preventing locking of the actuator.

20. The method of claim 9, further comprising preventing locking of the actuator with a vent.

* * * * *